US006213631B1

(12) United States Patent
Miranda

(10) Patent No.: US 6,213,631 B1
(45) Date of Patent: Apr. 10, 2001

(54) ADAPTER FOR SEALANT TUBE

(76) Inventor: Barbara J. Miranda, 4588 S. 20th St., Milwaukee, WI (US) 53221

( * ) Notice: Subject to any disclaimer, the term of this patent is extended or adjusted under 35 U.S.C. 154(b) by 0 days.

(21) Appl. No.: 09/475,564

(22) Filed: Dec. 30, 1999

(51) Int. Cl.[7] ..... B01F 15/00; B01F 9/00
(52) U.S. Cl. ..... 366/130; 366/213; 366/349
(58) Field of Search ..... 403/348, 335, 403/336, 338; 464/137, 155, 153, 901; 366/349, 130, 129, 218, 209, 213, 220, 199

(56) References Cited

U.S. PATENT DOCUMENTS

| | | | | |
|---|---|---|---|---|
| 614,502 | * | 11/1898 | Richards | 464/137 |
| 1,814,836 | * | 7/1931 | Lederman | 464/137 |
| 1,998,244 | * | 4/1935 | Lang | 403/348 |
| 2,552,682 | | 5/1951 | Lopez . | |
| 2,696,719 | | 12/1954 | Sklar . | |
| 2,731,006 | | 1/1956 | Hensel . | |
| 2,905,453 | * | 9/1959 | Wise | 366/130 |
| 4,773,788 | * | 9/1988 | Ruhl | 403/348 |
| 4,840,601 | | 6/1989 | Denman . | |
| 4,905,872 | * | 3/1990 | Fischer | 366/130 |
| 5,070,633 | | 12/1991 | Liu . | |
| 5,088,218 | | 2/1992 | Liu . | |
| 5,098,193 | * | 3/1992 | Christensesn et al. | 366/130 |
| 5,134,795 | | 8/1992 | Wang . | |
| 5,330,388 | | 7/1994 | Blanding . | |
| 5,339,923 | | 8/1994 | Chen . | |

FOREIGN PATENT DOCUMENTS

| | | | | |
|---|---|---|---|---|
| 23354 | * | 1/1956 | (DE) | 403/348 |

* cited by examiner

*Primary Examiner*—Tony G. Soohoo
(74) *Attorney, Agent, or Firm*—Andrus, Sceales, Starke & Sawall, LLP

(57) ABSTRACT

An adapter is provided for mixing a hardener and sealant within a cartridge assembly having a handle rotatably and reciprocably mounted therein. The adapter includes a cylindrical base having a first flat surface provided with a coupling pin extending substantially perpendicular thereto. The coupling pin is adapted to be chucked into a power drill. The base has a second flat surface provided with a plurality of spaced apart, headed elements engageable with the cartridge assembly handle. The adapter is constructed and arranged to transfer rotary motion from the drill to the handle to enable mixing of the sealant and hardener together.

9 Claims, 2 Drawing Sheets

ADAPTER FOR SEALANT TUBE

FIELD OF THE INVENTION

This invention relates broadly to an adapter for transmitting motion from a powered rotary apparatus for a movable structure and, more particularly, pertains to an adapter for transmitting motion from a powered rotary drill to use in the mixing of two materials together.

BACKGROUND OF THE INVENTION

For many years, military and aircraft specifications have required that rivets, bolt holes, seams and other components in an aircraft be sealed by coating desired surfaces with an approved material. Such material typically is packaged in an unmixed form within a cartridge assembly containing a sealant which must be combined with a hardener before the resulting material can be applied. More particularly, the cartridge assembly is comprised of a tubular cartridge having a closed end for retaining a supply of sealant therein, and a tube containing a hardener which is injected into the cartridge with a separate push rod and then blended together with a sealant therein by means of a mixing vane on one end of the tube disposed within the cartridge. Another end of the hardener tube terminates outside the cartridge in a wheel handle which is simultaneously rotated and reciprocated by hand relative to a restricted open end of the cartridge in order to effect the necessary mixing of the sealant and hardener inside the cartridge. Because the sealant and hardener are extremely dense and highly viscous materials, it has always taken rigorous labor intensive efforts and an unreasonable amount of time to combine these ingredients before their application. Once the sealant and its hardener have been mixed, the hardener tube is removed and the mixture is applied through the restricted open end of the cartridge using variously sized and shaped nozzles, orifices, and dispensers.

Accordingly, there exists a definite need to provide for the more efficient mixing of sealant and hardener in a cartridge assembly. It is desirable to provide an adapter that may be employed to couple a powered rotary drill to the wheel handle of the standard cartridge assembly so as to eliminate the need for application of manual force.

It is one of object of the present invention to provide an interfacing device which will vastly improve the combining of a sealant and hardener as used in aircraft applications.

It is also an object of the present invention to provide a simplified adapter which is extremely durable, yet lightweight and may be carried easily in one's hand or pocket.

It is a further object of the present invention to provide an adapter which may be used with a variety of power drills and various wheel handles of cartridge assemblies.

It is another object of the present invention to provide an adapter which is reasonably inexpensive to manufacture, that may be conveniently and quickly used, and that consists of a one-piece design with no moving parts.

Yet another object of the present invention is to provide an adapter which is corrosion-resistant and does not necessitate special tools to install or remove, nor require any maintenance.

In one aspect of the invention, an adapter is provided for mixing a hardener and a sealant within a cartridge assembly having a handle rotatably and reciprocably mounted therein. The adapter includes a cylindrical base having a first flat surface provided with a coupling pin extending substantially perpendicular thereto. The coupling pin is adapted to be chucked into a powered drill. The base has a second flat surface provided with a plurality of spaced apart, headed elements engageable within the cartridge assembly handle. The adapter is constructed and arranged to transfer rotary motion from the drill to the handle to enable mixing of the sealant and hardener together. The adapter is preferably constructed of stainless steel, and the headed elements are a pair of rivets of identical construction. The periphery of the base is slightly smaller than the periphery of the handle. The handle is formed with walls defining a pair of spaced apart apertures, the walls being engageable with the headed elements.

In another aspect of the invention, there is provided an arrangement for mixing materials together. The cartridge assembly includes a tubular cartridge holding a seal therein and having a closed end and an open end. The cartridge assembly further has a tube slidably and rotatably mounted relative to the open end of the cartridge and holding a hardener therein. The tube has an open end for introducing hardener into the cartridge, the tube open end being provided with a structure for mixing the sealant with the hardener. The tube also has a closed end external to the cartridge and is provided with a wheel handle for rotating and reciprocating the tube inside the cartridge. The handle has a flat mounting surface formed with walls defining a pair of spaced apart apertures therein. An adapter has a base with one side in contact with the handle mounting surface and includes a pair of rivets aligned with an engageable with the walls forming the apertures. The base has an opposite side provided with a coupling pin extending substantially perpendicular thereto and adapted to be retained in a powered drill. With this construction, upon initial rotary motion of the drill, the rivets contact the walls forming the apertures so as to enable slidable and rotary movement of the tube and the mixing structure for combining the sealant and hardener together in the cartridge. The cartridge, the tube and the handle are preferably constructed of a high density, polyethylene material.

In yet another aspect of the invention, there is contemplated a method for mixing a hardener and sealant within a cartridge assembly having a handle rotatably and reciprocably mounted therein. The method includes the step of providing an adapter comprised of a cylindrical base having a first flat surface provided with a coupling pin extending substantially perpendicular thereto, and a second flat surface opposite the first flat surface having a pair of spaced apart rivets, the coupling pin adapted to be received in a powered drill; and engaging the handle of the cartridge assembly with the rivets so as to transfer rotary motion from the drill to the handle.

There has been outlined the more important features of the invention in order that the detailed description thereof that follows may be better understood, and in order that the present contribution to the art may be better appreciated. There are, of course, additional features of the invention that will be described hereinafter and which will form the subject matter of the claims appended thereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
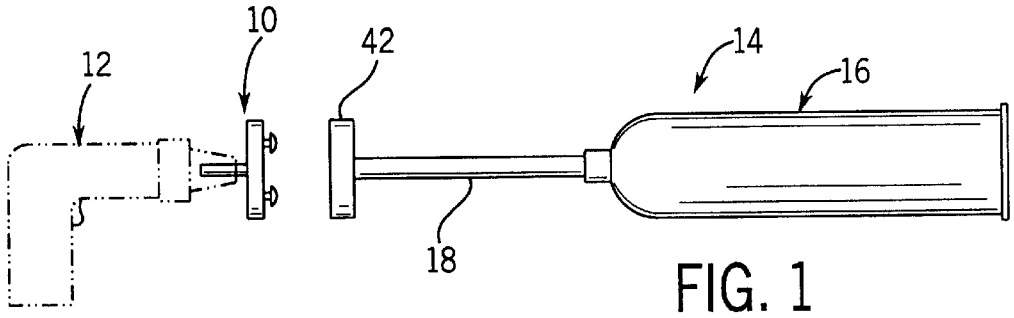
FIG. 1 is an elevational view of a drill adapter adapted to be connected with a sealant cartridge assembly according to the invention.

Referring now to FIG. 1, where the present invention is generally identified by reference numeral 10, it can be seen that the invention basically relates to an adapter 10 interposed between the chuck of a powered rotary drill 12 and a cartridge assembly 14. In the preferred embodiment, the drill 12 is represented conveniently as a rechargeable battery-type drill, but it should be appreciated that the drill may otherwise be electrically or pneumatically powered so as to provide a mechanized rotary force.

Figure 4:
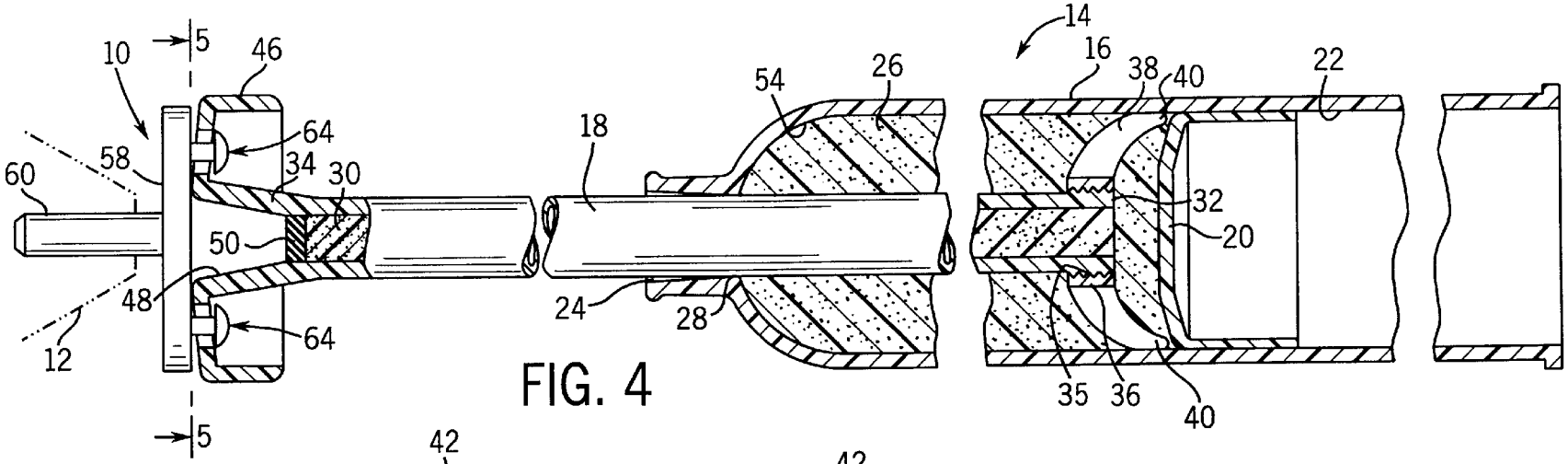
FIG. 4 is an enlarged, fragmentary cross sectional view of the interconnected adapter and the sealant cartridge assembly shown in FIG. 1.

As seen in FIGS. 1 and 4, the cartridge assembly 14 is comprised of an HDPE (high density polyethylene) thermoplastic material having a tubular cartridge 16 and a hardener tube 18. Cartridge 16 is closed at one end thereof by means of an end cap 20 in tightly sealed relationship with the inside diameter 22 of the cartridge 16. An opposite end of the cartridge 16 has a restricted open end 24 through which elongated tube 18 is slidably and rotatably mounted. A portion of the cartridge 16 is filled with a highly viscous and dense sealant 26 which is constrained therein by the end cap 20 and the sealing engagement of the open end 24 with the tube 18, as shown at 28.

The tube 18 contains a supply of hardener 30 similar in viscosity and density or thickness to sealant 26 and has an open end 32 and a closed end 34. The open end 32 allows hardener 30 to be introduced into the sealant 26 and includes an outer diameter which is threaded at 35 so as to be screwed clockwise into a threaded hub 36 of a mixing vane 38 having outer ends 40 in tight but sliding contact with the inside surface 22 of the cartridge 16. The closed end 34 is provided with a cylindrical wheel handle 42 having a disc 44 with a depending side wall 46. The disc 44 is formed with a center cavity 48 in communication with a movable plug 50 positioned in the tube 18 so as to initially retain the hardener 30 in the tube 18. From FIG. 3, it should be noted that the disc 44 ramps slightly downward radially from the center cavity 48 to the side wall 46. The wheel handle disc 44 is also provided with a pair of diametrically opposed apertures 52 which are spaced generally equidistantly from the center cavity 48.

At this point, it should be understood that in the prior art, one hand was placed on the sealant cartridge 16, while the other hand firmly grasped the wheel handle 42. In order to inject the hardener 30 into the sealant 26, a push rod (not shown) was inserted into cavity 48 and plug 50 is pushed to introduce hardener 30 through open end 32. Then, to mix the sealant 26 with the hardener 30, the wheel handle 42 was manually pushed forward and simultaneously rotated in one direction so as to concurrently rotate the mixing vane 38. FIG. 4 illustrates the forwardmost position of the mixing vane 38 as it contacts the end cap 20. Next, the wheel handle 42 and tube 18 are withdrawn or pulled back until the mixing vane 38 reaches its rearwardmost position and contacts the inner surface of the cartridge at 54. This rotating and reciprocating cycle many times is repeated until the hardener 30 is totally mixed together in the cartridge 16. It is important to realize the repeated manual motion for combining the sealant 26 and hardener 30 requires an undue amount of exertion and is very labor intensive.

Figure 2:
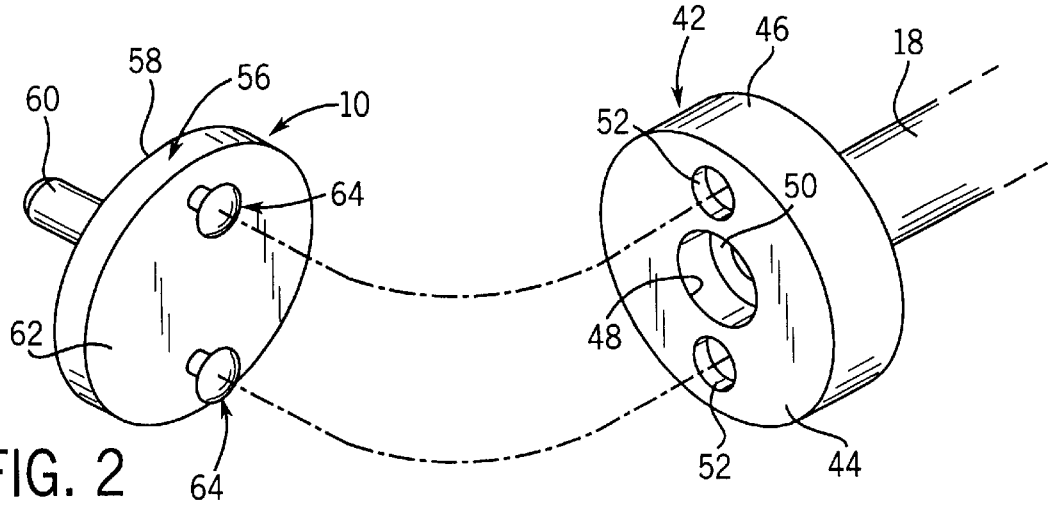
FIG. 2 is an enlarged and exploded, isometric view of the interconnection between the drill adapter and a wheeled handle at the outer end of a movable tube filled with a hardener to be mixed in the sealant cartridge.
Figure 3:
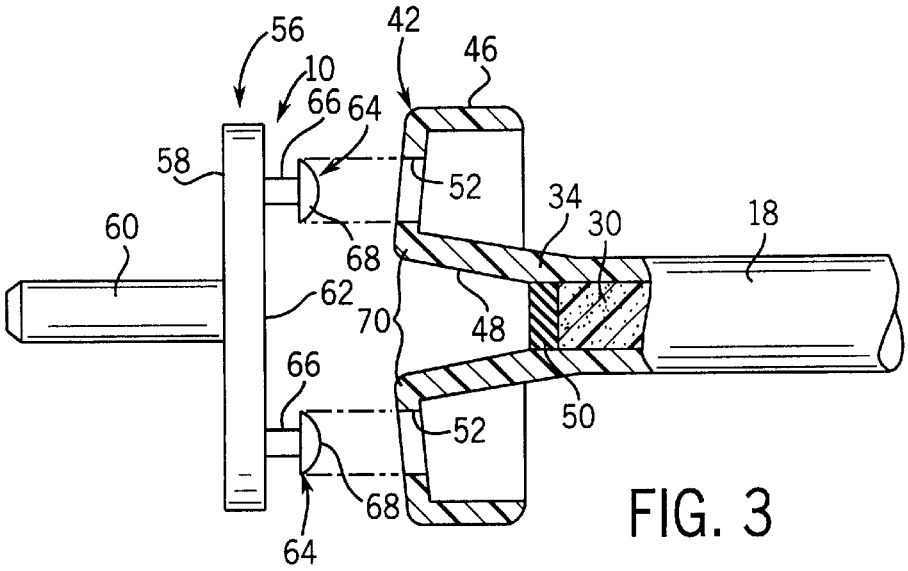
FIG. 3 is an elevational view partially in cross section of the interconnection shown in FIG. 2.

In accordance with the present invention, the adapter 10 interposed between the rotary drill 12 and the cartridge assembly 14 is designed to eliminate the manual exertion experienced with prior art cartridge assemblies after the hardener 30 has been injected into the cartridge 16. As best seen in FIGS. 2 and 3, the adapter 10 is preferably formed of a corrosion-resistant, durable stainless steel material which is compact and lightweight enough to be carried in one's hand or pocket. The adapter 10 has a cylindrical base 56 having a first flat surface 58 provided with a coupling pin 60 extending substantially perpendicular thereto and from the center thereof. In the preferred embodiment, the coupling pin 60 is threaded on one end and screwed into a central opening tapped in the base. The adapter 10 also has a second flat surface 62 opposite the first surface 58 provided with a pair of diametrically opposed, spaced apart, headed elements 64, preferably rivets. Each of the rivets 64 is identical in construction and includes a short cylindrical shaft 66 and a rounded head 68. Typically, the base 56 is tapped with appropriately sized holes into which the shafts 66 of the rivets 64 are secured. The rivets 64 are positioned so as to be aligned with the apertures 52 in the wheel handle 42 and engageable with the walls forming the apertures 52. In addition, the central area of the second flat surface 62 on the adapter 10 is engageable against a crown or highest portion 70 of the wheel handle disc 44 as shown in FIG. 4. The coupling pin 60 is adapted to be chucked into the retaining jaws of the rotary drill 12.

Figure 7:
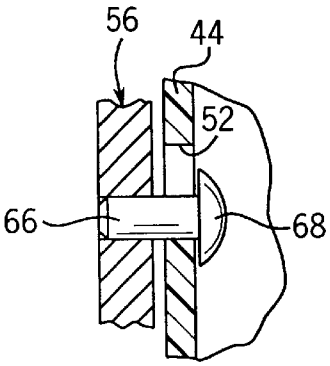
FIG. 7 is a fragmentary sectional view taken on line 7—7 of FIG. 6.
Figure 6:
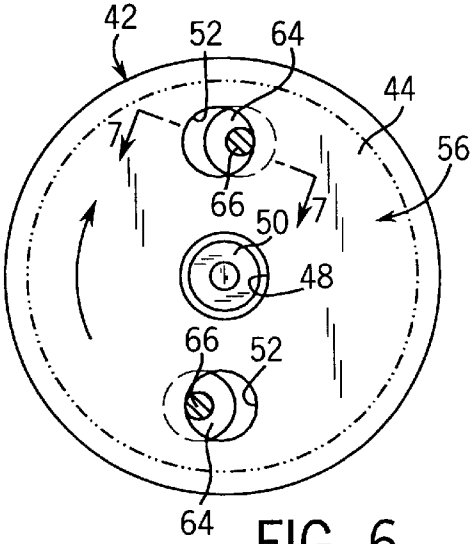
FIG. 6 is a view similar to FIG. 5, but showing the adapter position relative to the wheel handle during its initial rotation.
Figure 5:
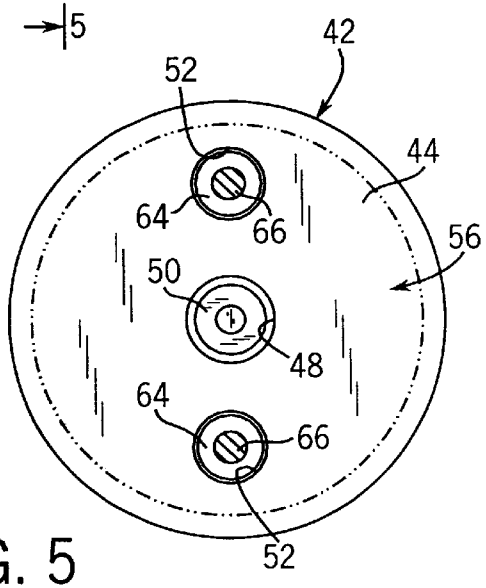
FIG. 5 is an enlarged sectional view taken on line 5—5 of FIG. 4.

Referring now to FIG. 5, it can been seen that the apertures 52 in the wheel handle 42 are dimensioned so that the rivet heads 68 pass therethrough. With the coupling pin 60 inserted in the drill 12, the adapter 10 is initially rotated as represented by the clockwise arrow in FIG. 6. This motion also depicted in FIG. 7 will cause the rivet shafts 66 to contact the walls forming the apertures 52, and will prevent the rivet heads 68 from being extracted through the wheel handle apertures 52. Continuous rotary motion transmitted by the drill 12 will automatically rotate the wheel handle 42 and hardener tube 18 relative to the cartridge 16 which is usually held stationary by one's hand. As the rotary motion is transmitted to the mixing vane 38 inside cartridge 16, the drill 12 is simultaneously moved back and forth along the longitudinal axis of the cartridge 16 to effect mixing of the sealant 26 and hardener 30.

Once the sealant 26 and hardener 30 have been combined, the wheel handle 42 is rotated in a direction opposite to that applied during mixing, such as by reversing the drill 12 in a counterclockwise direction, so that the threaded end 35 of tube 18 is disconnected from the mixing vane 38. Then, the hardener tube 18 is withdrawn from the cartridge 16, so that the combined sealant 26 and hardener 30 can be dispensed as desired through the now unrestricted open end 24 of the cartridge 16. This is done manually, or with a separate gun dispenser by pushing against the end cap 20 in the cartridge 16.

It should be appreciated that the adapter 10 of the present invention is a valuable, yet inexpensive and time saving accessory which can markedly improve the mixing of a sealing compound. The invention is particularly useful in aircraft and military environments where many components can be safely sealed in a reduced period of time.

While the invention has been described for combining a sealant and a cartridge with a hardener in the tube, it should be understood that the adapter 10 may also be utilized to mix a single ingredient or multiple ingredients which are already combined together. That is, the adapter 10 can be used with a drill 12 to impart a rotational mixing force only without the need for reciprocal movement along an axis.

Various alternatives and embodiments are contemplated as being within the scope of the following claims particularly pointing out and distinctly claiming the subject matter regarded as the invention.

I claim:

1. An interfacing device for mixing a hardener and a sealant within a container, the device comprising:

a cartridge assembly including a tubular cartridge holding the hardener and the sealant therein, the cartridge including a tube slidably and rotatable mounted therein and having a mixing element at one end located inside the cartridge and a rotatable handle at an opposite end located outside the cartridge; and an adapter in the form of: a cylindrical base having a first flat surface provided with a coupling pin extending substantially perpendicular thereto, the coupling pin adapted to be chucked into a powered drill, the base having a second flat surface provided with a plurality of spaced apart, headed elements engageable within the cartridge assembly handle, the adapter being constructed and arranged to transfer rotary motion from the drill to the handle and the mixing element to enable mixing of the sealant and the hardener together.

2. The adapter of claim 1, wherein the device is constructed of stainless steel.

3. The device of claim 1, wherein the headed elements are rivets of identical construction.

4. The device of claim 1, wherein the plurality is a pair.

5. The device of claim 1, wherein the periphery of the base is slightly smaller than the periphery of the handle.

6. The device of claim 1, wherein the handle is formed with walls defining a pair of spaced apart apertures, the walls being engageable with the headed elements.

7. An arrangement for mixing materials together comprising:

a cartridge assembly including a tubular cartridge holding a sealant therein and having a closed end and an open end, the cartridge assembly further having a tube slidably and rotatably mounted relative to the open end of the cartridge and holding a hardener therein, the tube having an open end for introducing a hardener into the cartridge, the tube open end being provided with a structure for mixing the sealant with the hardener, the tube also having a closed end external to the cartridge and provided with a plug movably mounted in the tube and a wheel handle for rotating and reciprocating the tube inside the cartridge, the handle having a flat mounting surface formed with walls defining a pair of spaced apart apertures therein; and an adapter having a base with one side in contact with the handle mounting surface and including a pair of rivets aligned with and engageable with the walls forming the apertures, the base having an opposite side provided with a coupling pin extending substantially perpendicular thereto and adapted to be retained in a powered drill, whereby, upon initial rotary motion of the drill, the rivets contact the walls forming the apertures so as to enable slidable and rotary movement of the tube and mixing structure for combining the sealant and hardener together in the cartridge.

8. The arrangement of claim 7, wherein the cartridge, the tube and the handle are constructed of a high density polyethylene material.

9. A method for mixing a hardener and a sealant together, the method comprising the steps of:

providing a cartridge assembly containing a hardener and sealant and having a tube rotatable and reciprocably mounted therein, there being a handle at one end of the tube outside the cartridge assembly and a mixing vane at an opposite end of the tube inside the cartridge assembly for mixing the hardener and sealant in the cartridge assembly;

providing an adapter comprised of a cylindrical base having a first flat surface provided with a coupling pin and extending substantially perpendicular thereto, and a second flat surface opposite the first flat surface having a pair of spaced apart rivets, the coupling pin adapted to be received in a powered drill; and engaging the handle of the cartridge assembly with the rivets so as to transfer rotary motion from the drill to the handle and to the mixing vane so as to mix the hardener and sealant in the cartridge assembly.

* * * * *